US009144323B2

(12) United States Patent
Lindblom

(10) Patent No.: US 9,144,323 B2
(45) Date of Patent: Sep. 29, 2015

(54) ARRANGEMENT FOR ADJUSTING THE LENGTH OF A CARRYING SECTION OF A CHILD CARRIER

(71) Applicant: BABYIDEA OY, Vantaa (FI)

(72) Inventor: Bettina Lindblom, Helsinki (FI)

(73) Assignee: BABYIDEA OY, Vantaa (FI)

( * ) Notice: Subject to any disclaimer, the term of this patent is extended or adjusted under 35 U.S.C. 154(b) by 0 days.

(21) Appl. No.: 14/547,811

(22) Filed: Nov. 19, 2014

(65) Prior Publication Data

US 2015/0069097 A1 Mar. 12, 2015

Related U.S. Application Data

(63) Continuation-in-part of application No. 12/678,080, filed as application No. PCT/FI2008/050509 on Sep. 12, 2008, now abandoned.

(30) Foreign Application Priority Data

Sep. 13, 2007 (FI) ..... 20075641

(51) Int. Cl.
*A61G 5/00* (2006.01)
*A61G 1/00* (2006.01)
*A47D 13/02* (2006.01)

(52) U.S. Cl.
CPC ..... *A47D 13/025* (2013.01)

(58) Field of Classification Search
CPC ..... A47D 13/025; A47D 13/02
USPC ..... 224/158, 159, 160
See application file for complete search history.

(56) References Cited

U.S. PATENT DOCUMENTS

| | | | | |
|---|---|---|---|---|
| 3,587,952 | A | 6/1971 | Higuchi | |
| 3,780,919 | A * | 12/1973 | Hansson | 224/160 |
| 4,402,440 | A * | 9/1983 | Purtzer et al. | 224/160 |
| 4,428,514 | A | 1/1984 | Elf | |
| 5,205,450 | A | 4/1993 | Derosier | |
| 5,246,152 | A * | 9/1993 | Dotseth | 224/159 |
| 5,692,655 | A | 12/1997 | Fair et al. | |
| 5,772,088 | A | 6/1998 | Nelson | |
| 5,813,580 | A | 9/1998 | Fair | |
| 5,848,741 | A | 12/1998 | Fair | |
| 6,045,018 | A * | 4/2000 | Onishi | 224/158 |
| 6,666,361 | B1 | 12/2003 | Lin | |
| 6,715,651 | B2 | 4/2004 | Le Gal | |

(Continued)

FOREIGN PATENT DOCUMENTS

| | | |
|---|---|---|
| DE | 20 2005 001 300 U1 | 5/2005 |
| DE | 20 2005 007 372 U1 | 9/2005 |

(Continued)

*Primary Examiner* — Brian D Nash
*Assistant Examiner* — Derek Battisti
(74) *Attorney, Agent, or Firm* — Birch, Stewart, Kolasch & Birch, LLP

(57) ABSTRACT

The invention relates to an arrangement for adjusting the length of a carrying section of a child carrier, intended for carrying a child on an adult's front, back, or hip, the carrier comprising further upper support elements attached to the carrying section and to be placed over the wearer's shoulders, and lower support elements to be placed around the wearer's body, wherein the carrier is equipped with adjustment elements, with which a multi-stepped or stepless length adjustment of the carrying section is arranged to be carried out.

19 Claims, 14 Drawing Sheets

(56) References Cited

U.S. PATENT DOCUMENTS

| | | | | |
|---|---|---|---|---|
| 6,763,983 | B2 | 7/2004 | Norman | |
| 6,988,644 | B1 * | 1/2006 | Asherbranner | 224/160 |
| 7,322,498 | B2 | 1/2008 | Frost | |
| 7,484,645 | B2 | 2/2009 | Hoff et al. | |
| 7,766,199 | B1 | 8/2010 | Caperon | |
| 8,056,779 | B1 | 11/2011 | Brunwin | |
| 2001/0030210 | A1 | 10/2001 | Donine | |
| 2003/0178452 | A1 * | 9/2003 | Norman | 224/160 |
| 2005/0173479 | A1 | 8/2005 | Gentil | |
| 2005/0279785 | A1 | 12/2005 | Liistro et al. | |
| 2006/0048721 | A1 * | 3/2006 | Bergkvist | 119/770 |
| 2006/0138188 | A1 | 6/2006 | Kramer | |
| 2007/0029356 | A1 | 2/2007 | Moriguchi et al. | |
| 2008/0190972 | A1 | 8/2008 | Gray | |

FOREIGN PATENT DOCUMENTS

| | | | |
|---|---|---|---|
| FR | 2 546 389 | A1 | 11/1984 |
| FR | 2 794 010 | A1 | 12/2000 |
| WO | WO 03/082058 | A2 | 10/2003 |
| WO | WO 2008/135156 | A1 | 11/2008 |

* cited by examiner

ARRANGEMENT FOR ADJUSTING THE LENGTH OF A CARRYING SECTION OF A CHILD CARRIER

This application is a Continuation-in-Part of the co-pending application Ser. No. 12/678,080 filed on May 13, 2010, which was filed as PCT International Application No. PCT/FI2008/050509 on Sep. 12, 2008, and under 35 U.S.C. §119 (a) to Patent Application No. 20075641, filed in Finland on Sep. 13, 2007, all of which are hereby expressly incorporated by reference into the present application.

BACKGROUND OF THE INVENTION

The present invention relates to an arrangement for adjusting the length of a carrying section of a child carrier intended particularly for carrying a child on an adult's front, back, or hip. The carrier has been supplied with the length adjustment of the carrying section, to make the same carrier ergonomically suitable for infant babies as well as for larger toddlers well until their pre-school years.

In prior art, various fabrics or their combinations are used for sewing carriers in a form of, for instance, a back carrier, a front carrier or a mei tai, with upper straps, which go over the wearer's shoulders, as well as lower straps or a hip belt, which are attached around the waist or hip, and occasionally also other straps such as a chest strap, which holds the upper straps in place. Between the straps there is a carrying section that can be realized in various ways, somewhat formed e.g. into a shape of a cup or into a rectangle or square. Ergonomically, the carrying section should support the child's back all the way up. This is particularly important for a small baby and for a baby who is sleeping or moving actively in the carrier, in order for the carrier to be safe for the baby and for the carrying to be pleasant for the wearer and to the child. When the carrying section supports the child's back all the way up, or at least up to the level of the arm pits, the mass center of the child stays close to the wearer. During the most active carrying period, from newborn to about a two-year-old, the child will grow by dozens of centimeters.

Furthermore, carriers are often used occasionally for carrying larger children, for instance on longer distances, at airports or while hiking, and for handicapped or other children with special needs. Most carriers according to prior art make compromises regarding the height of the carrying section to make it suitable for children aged approximately six to eighteen months. This makes it too high for small babies and too low for larger children. Thus, a carrier that is suitable for a twelve-month-old is not suitable for ergonomic carrying of a small baby or a larger child. For some carriers, the problem has been solved by adding a separate inner part for smaller babies. This adds to the fabric layers of the carriers, which is undesirable in hot weather, warm climates or indoor use. Nor does the separate inner section solve the problem in terms of the ergonomics of carrying larger children. Other carriers are sold in various sizes, in which case a family has to buy several carriers for the same child or an own carrier for each child of a various age.

In prior art, the main points of focus in the design solutions for the various carriers on the market have, naturally been safety, ease of use and comfort primarily for the wearer and to some degree for the child. Ergonomy, in particular from the child's point of view, is quite a recent consideration. The solutions that exist tend to come in the form of added-on features, for instance a detachable or foldable head support or a separate insert for smaller children or infants. The drawbacks of these solutions are that they add to the complexity of the product, which, on one hand, reduces the ease-of-use and, on the other hand, adds to both the weight of the product, which is an important consideration moving around with a child, and to the cost of the product, making it less affordable and, thus, less desirable. A separate issue is that the size and measurements and the relationship between different measurements, for instance, the size and the placement of possible arm and leg openings, do not easily change and adjust with the add-on features during the period of rapid growth of a young child. Thus, add-on features are usually less than optimal and entail important tradeoffs often in the area of ergonomy for the child. As an example, a headrest can not easily be used for supporting a longer back of the child if it results in that the arm openings are getting "in the wrong place".

SUMMARY OF THE INVENTION

The object of this invention is to remove the disadvantages described above and to achieve an advantageous and easily modifiable, reliable and ergonomic arrangement for adjusting the height of a carrier intended particularly for carrying children, where the height can be increased as a child grows or falls asleep, and easily decreased again when the child wants to see more, or the adult is about to carry another child of different size. The height adjustment here means the length adjustment of the back part of the carrying section of the carrier. The back part is usually supporting the back of the child.

According to one embodiment of the present invention, an arrangement for adjusting the length of a carrying section of an infant carrier is disclosed, in which arrangement the infant carrier comprises a carrying section intended for carrying a child on an adult's front, back, or hip, and further upper support elements attached to the carrying section and intended to be placed over the wearer's shoulders as shoulder straps, and lower support elements to be placed around the wearer's body, and where the carrier is equipped with adjustment elements with which a multi-stepped or stepless length adjustment of the carrying section is arranged to be carried out.

The advantages of the arrangement according to the invention include the fact that the length adjustment of the carrier's carrying section is multi-stepped or stepless, which allows the height of the carrier to be increased and decreased easily according to the size or needs of the child. As mentioned above the height adjustment here means actually the length adjustment of the vertical back part of the carrying section of the carrier so that the distance between the top edge of the carrying section and the lower edge of the carrying section is changed either longer or shorter. Later in this description the length adjustment is mentioned instead of the height adjustment. The vertical back part of the carrying section support usually the back of the child in the carrier, and the solution according to the invention makes it possible to lengthen and shorten the back part of the carrying section as for example the baby grows bigger, the baby falls asleep or has special needs. Later in this description the term carrying section means the back part of the carrying section.

Another benefit of the length adjustment of the arrangement according to the invention is that the same carrier is optimally suitable for children of different sizes, meaning that a family, or e.g. a children's private day care or a day-care center, does not have to purchase several carriers, if the children are carried at different times. The length adjustment of the carrying section can be a fixed part of the carrier or an additional piece or a removably fastened upper part. The length adjustment according to the invention is suitable for different carrier models, including back carriers, front carriers and square cloths—i.e. any equipment with a carrying section that supports the back or the front part of the child to be carried. The length adjustment according to the invention also enables the same carrier to be realized so that the child can be carried facing forward, because in such a position the length of the carrying section must be lower than when the child is carried facing the wearer. In addition, the length adjustment of the carrying section is useful when the baby is carried not only in vertical position but also in L-shaped or reclining position in the same carrier.

BRIEF DESCRIPTION OF THE DRAWINGS

In the following, the invention will be described in more detail by the aid of embodiment examples with reference to the attached drawings, wherein.

DETAILED DESCRIPTION OF THE INVENTION

Figure 1:
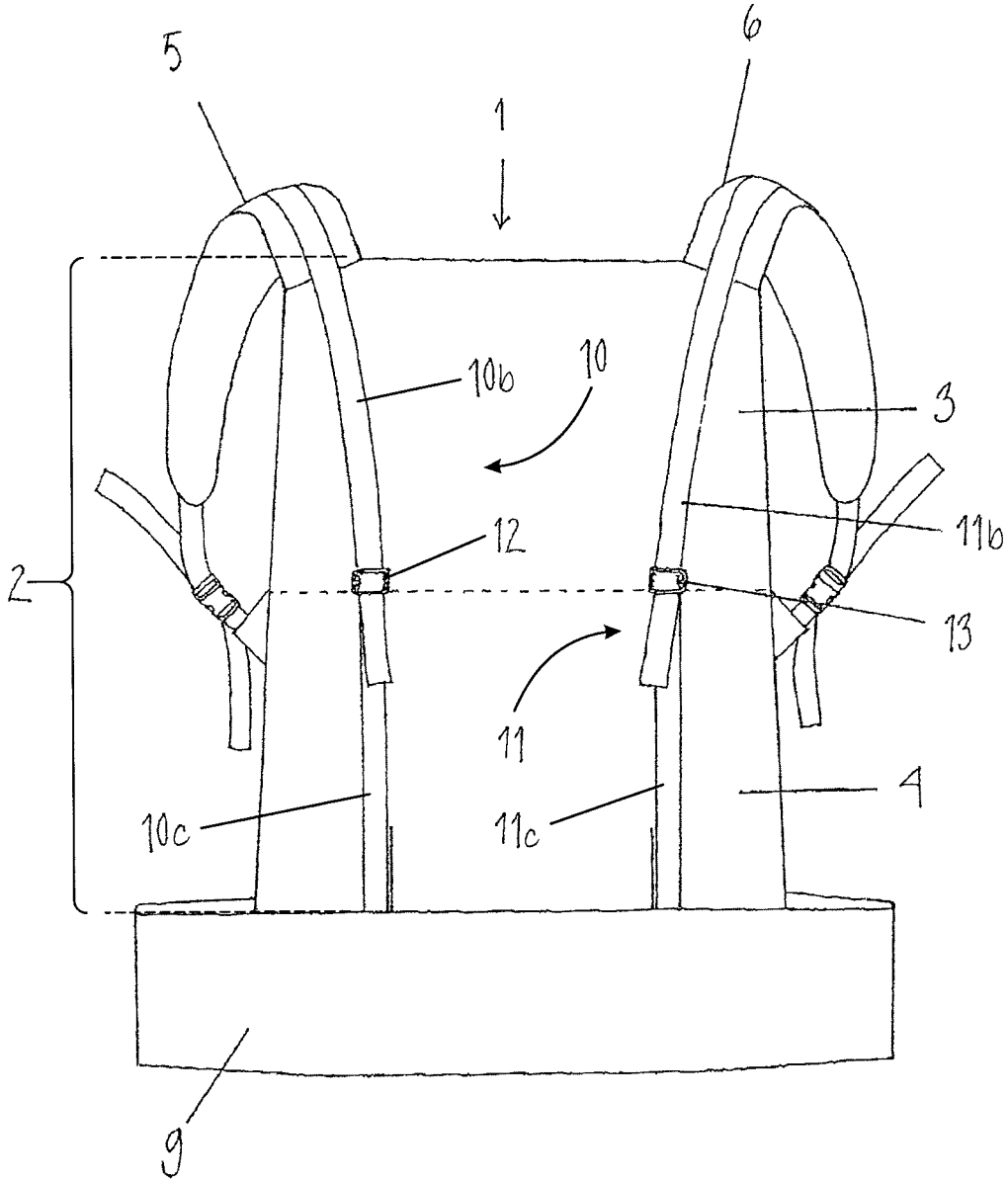
FIG. 1 presents an arrangement according to the invention for stepless length adjustment of the carrying section of a carrier, adjusted to the maximum length and viewed from the backside of the carrier.

FIG. 1 presents a child carrier 1 according to the invention, viewed from the backside of the carrier, i.e. from the outside towards the wearer, with the carrier hanging freely open. In this case the carrier would be positioned between the viewer and the wearer of the carrier. The carrier 1 comprises among other things of a carrying section 2 with an essentially vertical back part and a bum support part, upper support elements 5 and 6, such as upper shoulder straps placed on the wearer's shoulders, i.e. carrying straps. In addition, the carrier 1 has at least lower support elements to be adjusted around the wearer's body, which lower support elements consist for example of a hip belt 9 or for example of lower straps 7 and 8 presented in FIG. 10, or for example of both a hip belt 9 and lower straps 7 and 8.

The carrying section 2 in between the upper support elements 5, 6 and lower support elements 7, 8 or 9 can be realized in various ways, somewhat formed e.g. into a shape of a cup, or into a rectangle or square. A multi-stepped or stepless length adjustment of the vertical back part of the carrying section 2 of the carrier 1 has been developed for the carrier 1 according to the invention. The carrying section 2 can be divided into two essentially vertical parts that can be the same or different sizes, namely an upper part 3 and a lower part 4 of the carrying section 2, which parts 3 and 4 are advantageously mutually either of the same uniform material, integrated or otherwise joined to each other. The upper part 3 and the lower part 4 together form the vertical back part of the carrying section 2.

FIG. 1 presents a stepless length adjustment of the carrying section 2 of the carrier 1 according to the invention adjusted to the maximum length. That means that the length of the back part of the carrying section 2 or the distance from the top edge of the back part of the carrying section 2 to the lower edge of the back part of the carrying section 2 or to the lower support elements 7, 8 or 9 is at its maximum. At the same time the distance between the first end of the upper support elements 5 and 6, fastened to the top edge of the back part of the carrying section 2, and the lower support elements 7, 8 or 9 is at its maximum.

The length of the carrying section 2 has been fitted to be adjusted with webbing straps 10, 11 acting as adjustment elements and with buckles 12, 13 acting as adjustment means. The webbing straps 10, 11 and buckles 12, 13 are placed in between the upper support elements 5 and 6, and the hip belt 9 or the lower straps 7, 8. Advantageously the webbing straps 10, 11 and buckles 12, 13 are placed in between the top edge of the upper part 3 of the carrying section 2 and the lower edge of the lower part 4 of the carrying section 2.

Each adjustment element 10, 11 consists at least of an upper webbing part 10*b*, 11*b*, which is essentially attached near to the top edge of the upper part 3 of the carrying section 2 by its top end, and of a lower webbing part 10*c*, 11*c*, which is attachable to the upper webbing part 10*b*, 11*b* with the adjustment means, and which is attached by its lower end for example to the lower support elements, such as the hip belt 9 or the lower straps 7, 8.

The first ends or upper ends of the upper webbing parts 10*b*, 11*b* of the webbing straps 10, 11 are fastened on top of the upper support elements 5, 6 and/or on the top edge of the back part of the carrying section 2, and the second ends of the upper webbing parts 10*b*, 11*b* can be fastened and adjusted with the buckles 12, 13. Correspondingly, the first ends or lower ends of the lower webbing parts 10*c*, 11*c* of the webbing straps 10, 11 are fastened to the lower support elements 7, 8 or 9 or to the lower part 4 of the carrying section 2, and the second ends or the upper ends of the lower webbing parts 10*c*, 11*c* hold the buckles 12, 13 in place through which the upper webbing parts 10*b*, 11*b* are threaded.

Figure 2:
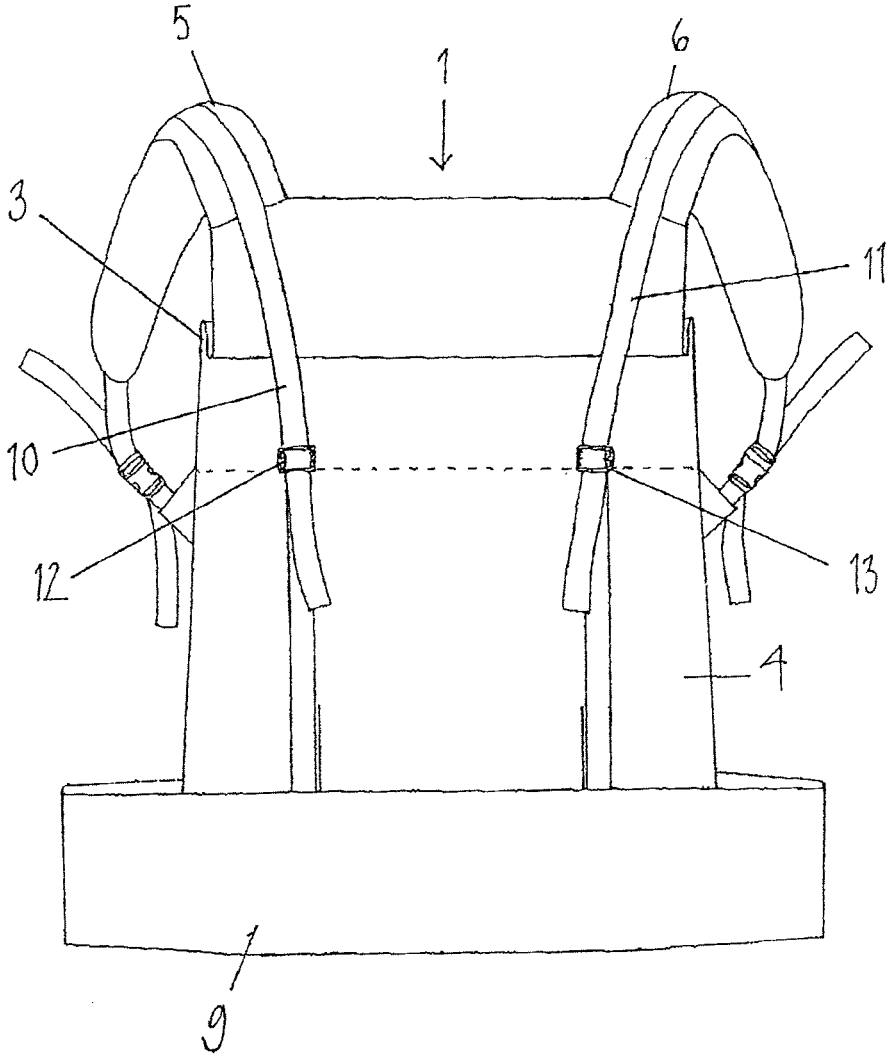
FIG. 2 presents a stepless length adjustment of the carrying section of a carrier according to the invention adjusted to a smaller size and viewed from the backside of the carrier.

FIG. 2 presents the carrier according to FIG. 1, where the stepless length adjustment is adjusted to a smaller length, in which case the upper part 3 of the carrying section 2 is slightly folded towards the hip belt 9. Now the distance from the top edge of the back part of the carrying section 2 to the lower edge of the back part of the carrying section 2 is smaller than in the situation according to FIG. 1. In other words, the length or the height of the carrying section 2 is now smaller.

Figure 3:
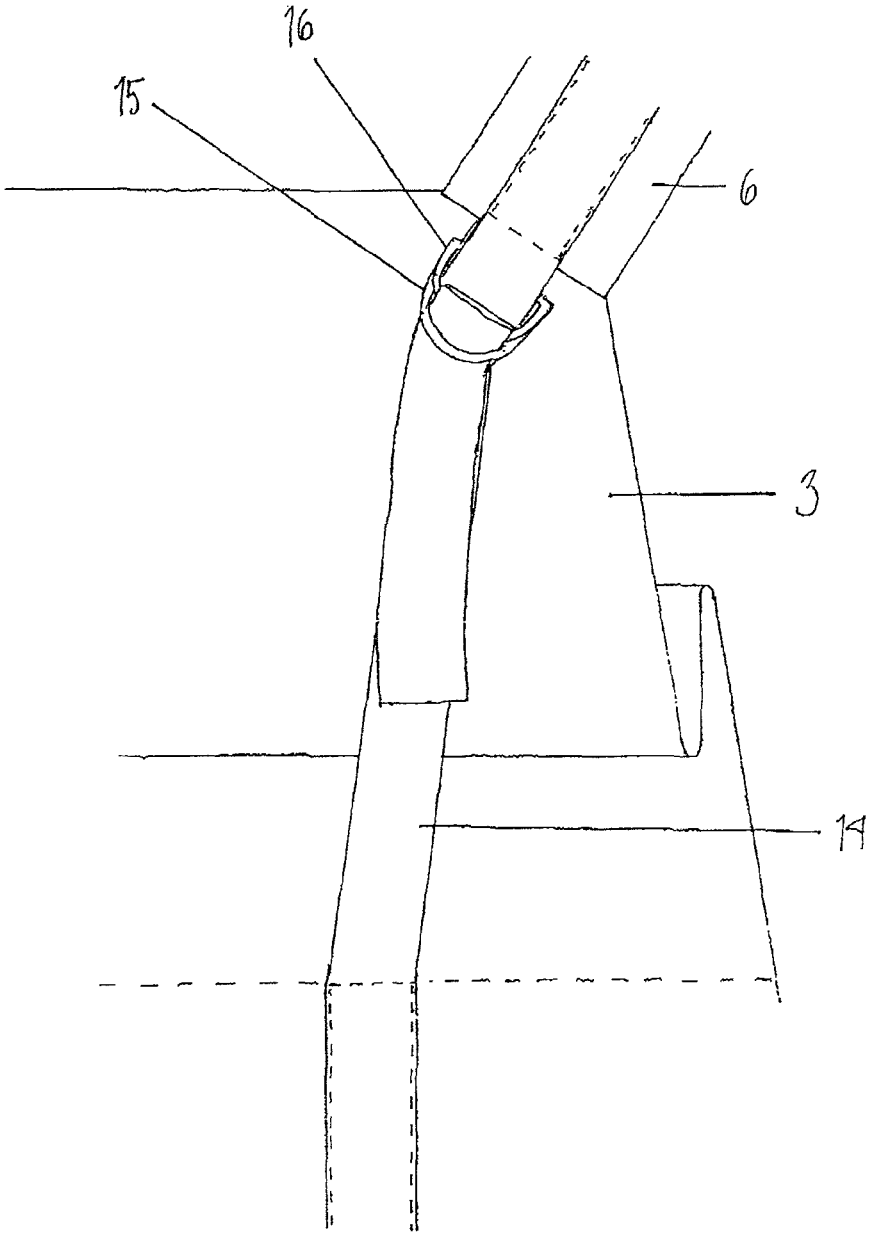
FIG. 3 presents an alternative detail of FIG. 2, where the adjustment means consist of webbings or webbing straps and D-rings.
Figure 4:
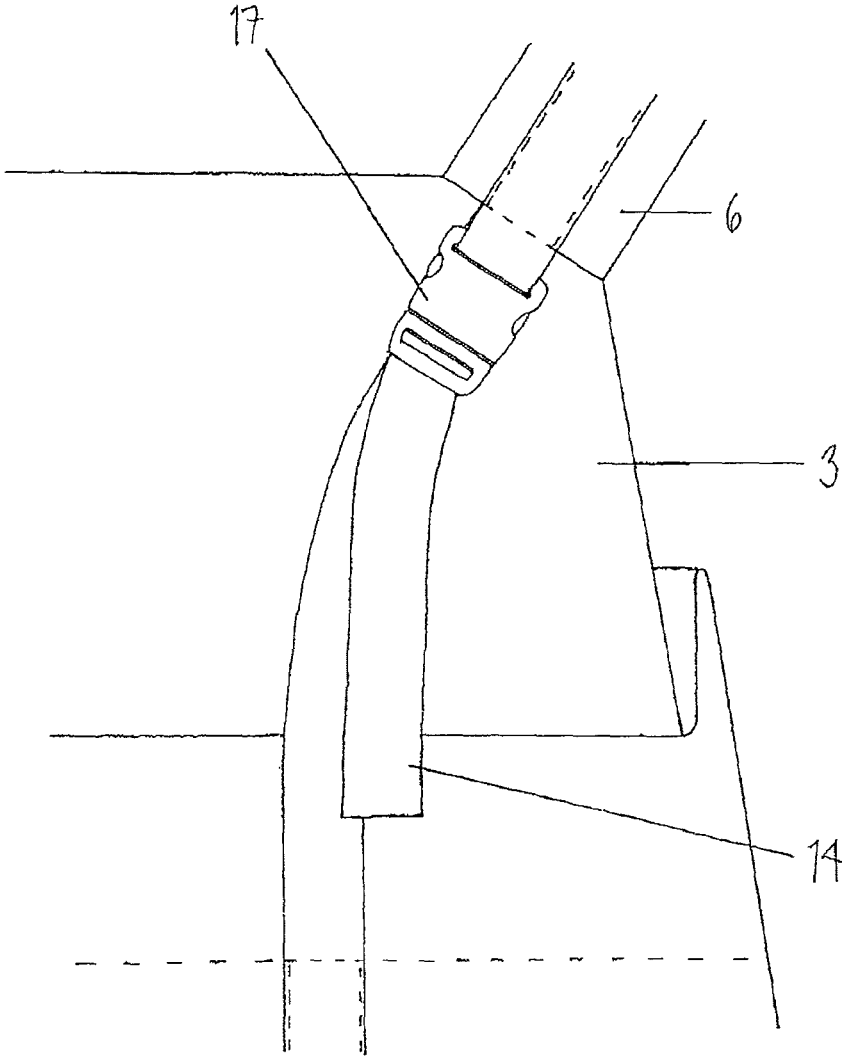
FIG. 4 presents an alternative detail of FIG. 2, where the adjustment means consist of webbings or webbing straps and buckles.
Figure 5:
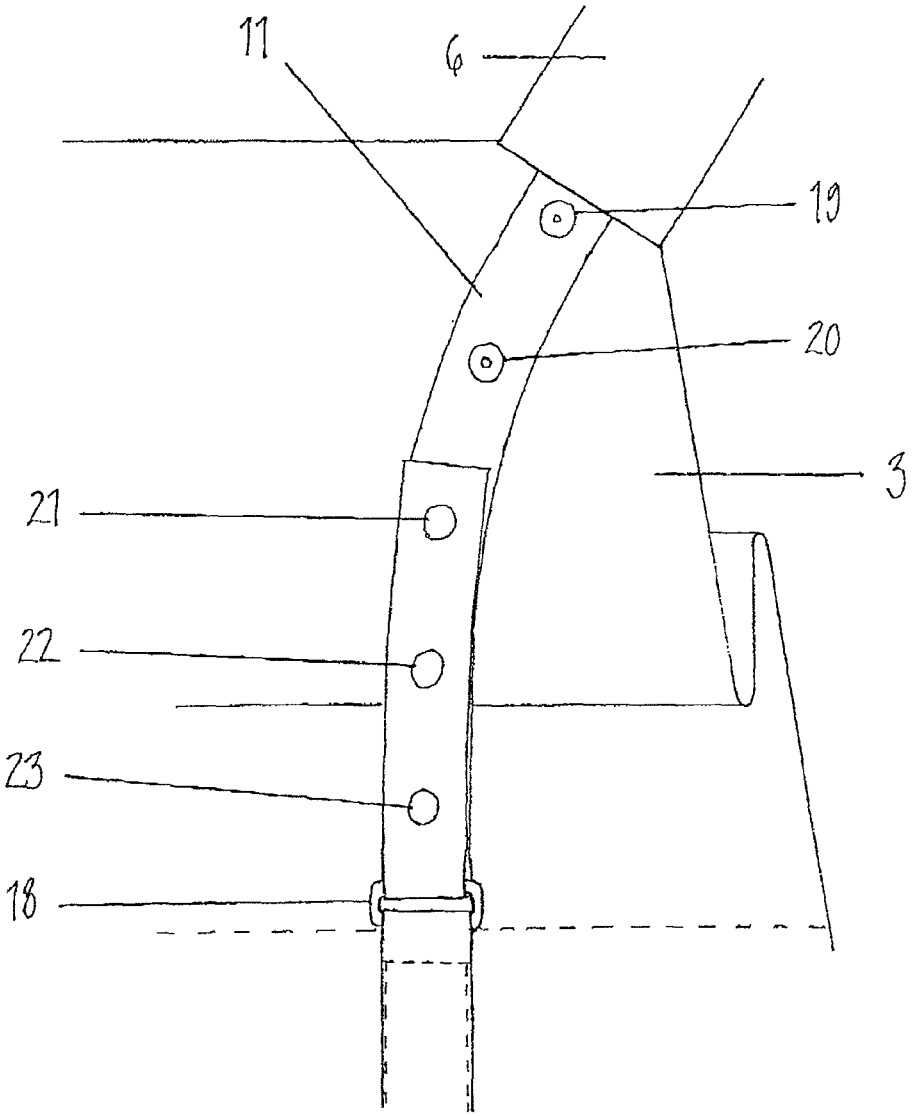
FIG. 5 presents an alternative detail of FIG. 2, where the adjustment means consist of webbings or webbing straps, buckles and snap fasteners.
Figure 6:
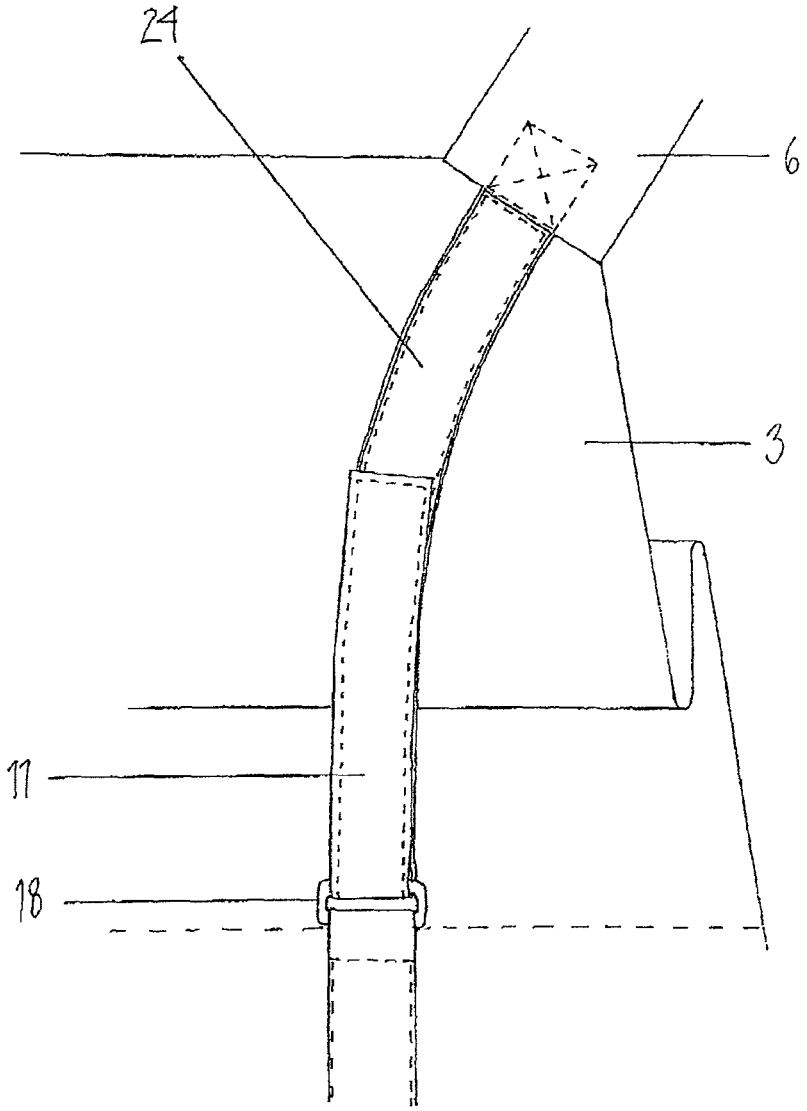
FIG. 6 presents an alternative detail of FIG. 2, where the adjustment means consists of a buckle and a hook-and-loop fastener system such as a Velcro tape sewn on a webbing or webbing strap.
Figure 7:
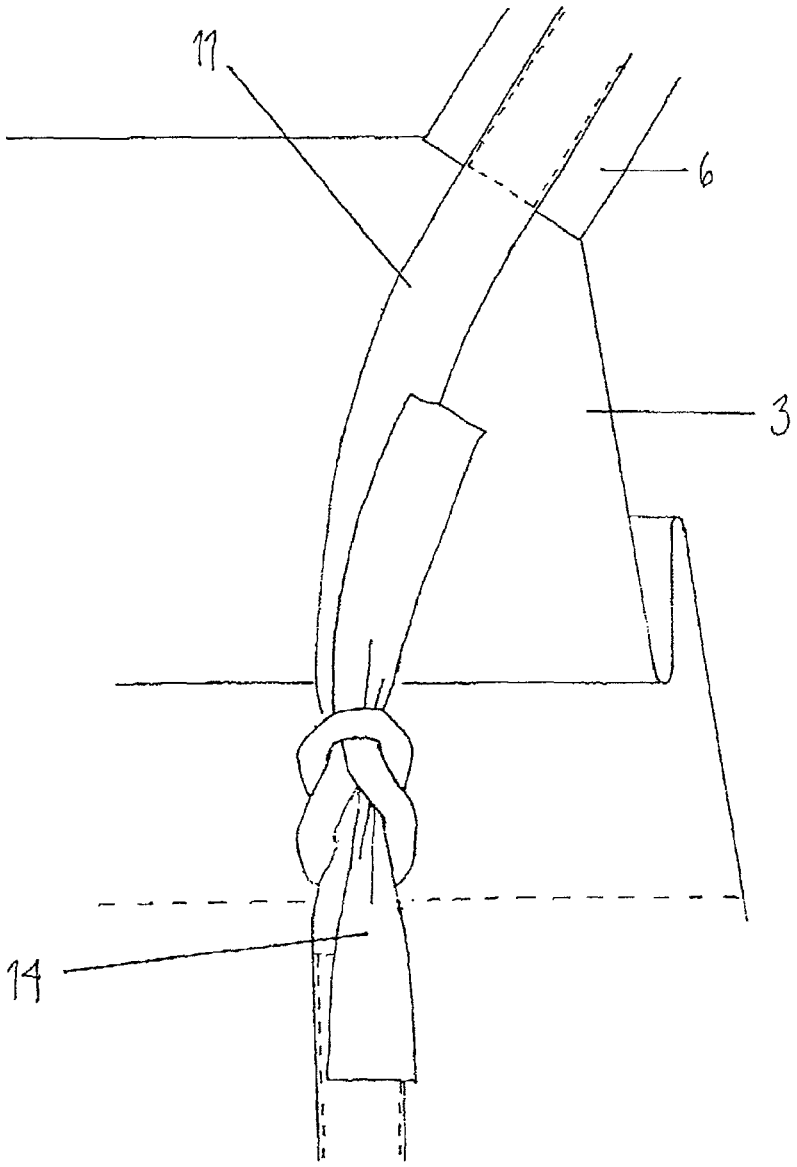
FIG. 7 presents an alternative detail of FIG. 2, where the adjustment means consist of webbings or webbing straps that can be tied to each other.
Figure 8:
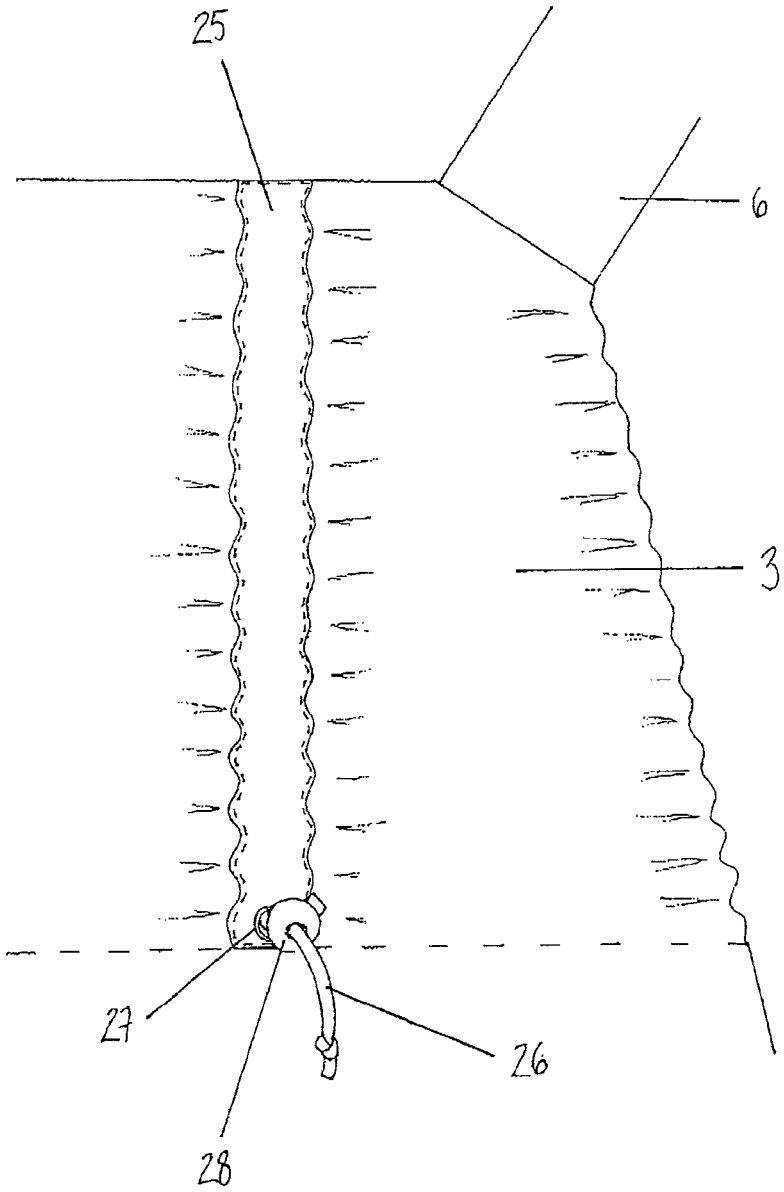
FIG. 8 presents an alternative detail of FIG. 2, where the adjustment means consist of a cord that runs inside a channel, a reinforcement ring and a cord lock.
Figure 9:
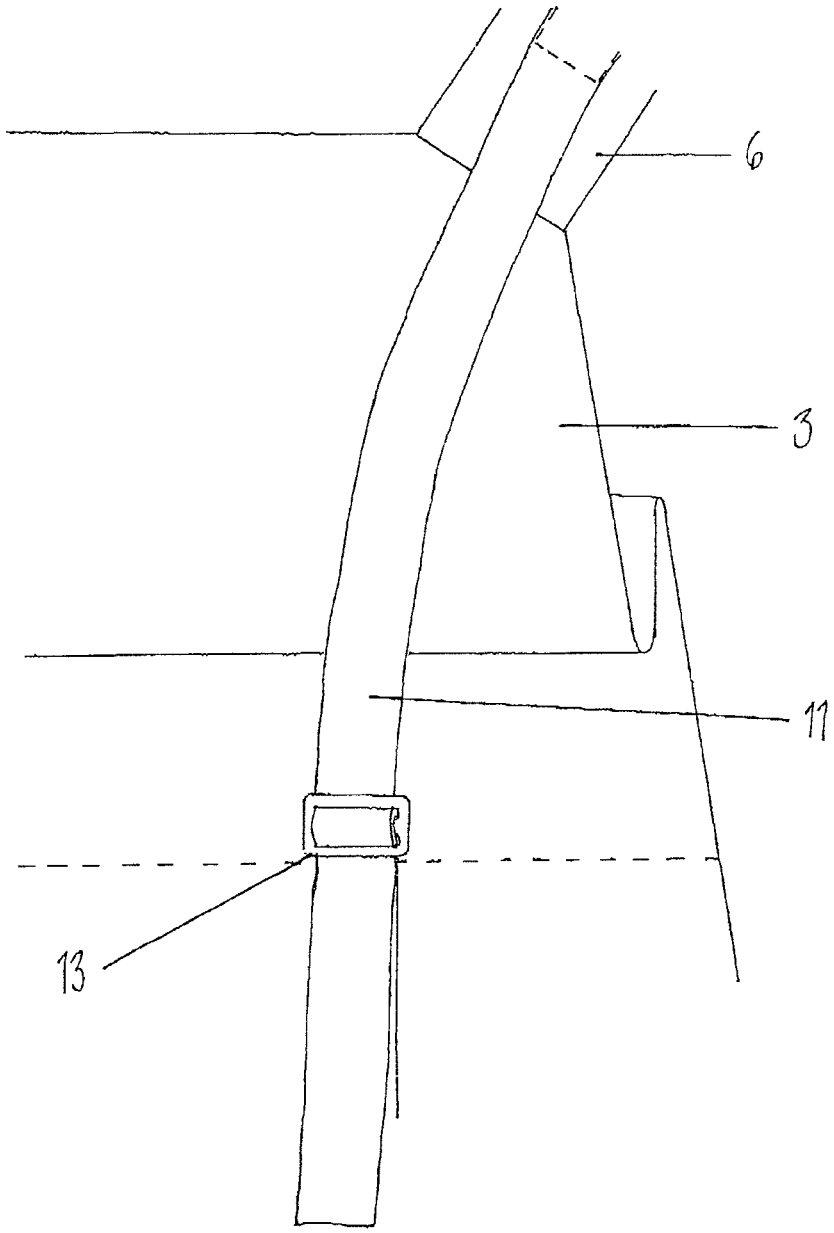
FIG. 9 presents an alternative detail of FIG. 2, where the webbings or webbing straps used as the adjustment means begin higher, close to or on top of the upper straps.

FIGS. 3-9 present alternative details of the embodiment presented in FIG. 2. In the solution according to FIG. 3 the adjustment elements consists of webbing straps 14 and the adjustment means consist of D-rings 15, 16 instead of buckles. Respectively, FIG. 4 presents a length adjustment solution, in which the adjustment elements consists of webbing straps 14 and the adjustment means consist of lockable buckles 17. In the solution presented in FIG. 5 the adjustment elements consists of webbing straps 11 and the adjustment means consist of buckles 18 and snap fasteners 19-23. Respectively, FIG. 6 presents a solution, in which a hook-and-loop fastener system such as a Velcro tape 24 and a buckle 18 acting as adjustment means has been sewn on to the webbing strap 11 acting as the adjustment element. In the solution according to FIG. 7 the adjustment elements consists of webbing straps 11, 14 that can be tied to each other, and in the embodiment presented in FIG. 8 the adjustment element consists of a cord 26 that runs inside a channel 25 and the adjustment means consist of a reinforcement ring 27 and a cord lock 28. FIG. 9 presents another solution; where the webbing straps 11 acting as the adjustment elements begin higher, close to or on top of the upper straps 5, 6.

Figure 10:
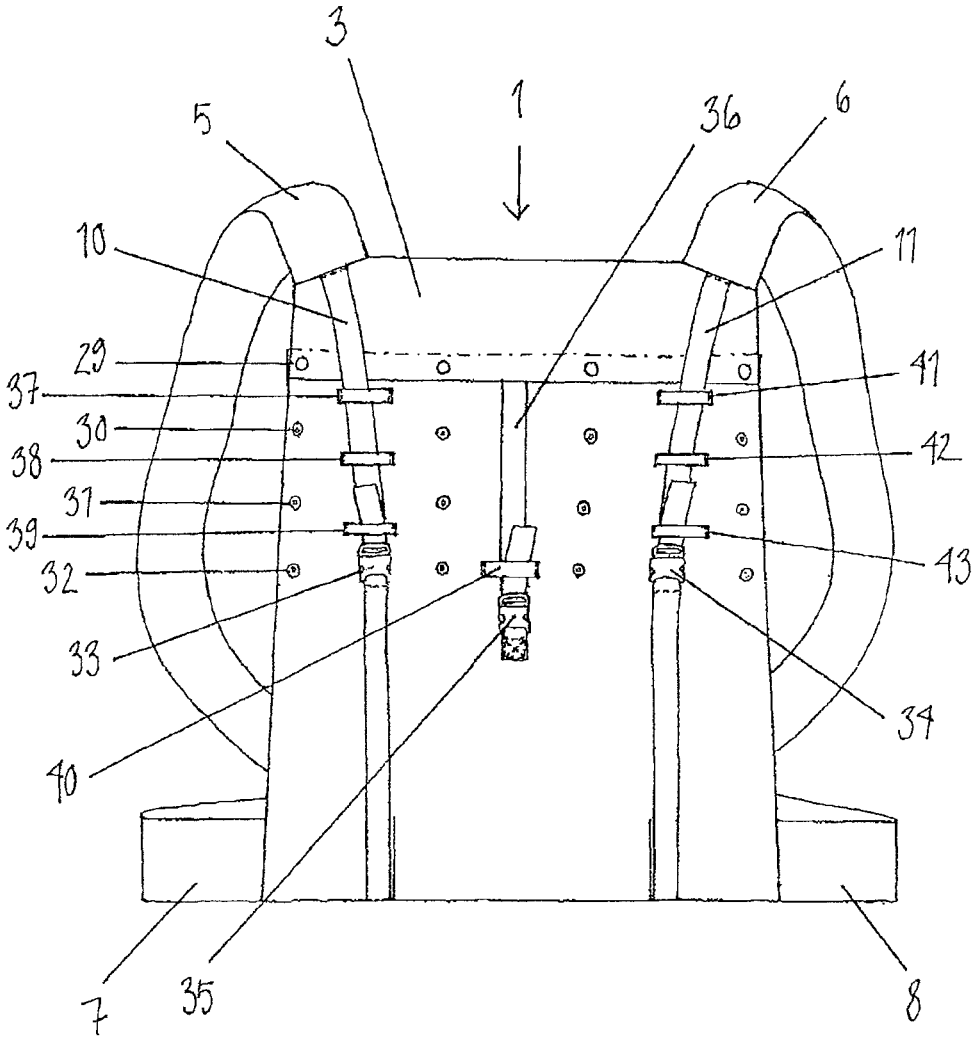
FIG. 10 presents a multi-stepped length adjustment according to the invention, viewed from the outer, back side of the carrier, where the upper part of the carrier is removably fastened and where the adjustment and attachment means consist of snap fastener rows, buckles and webbings or webbing straps, and also support loops.
Figure 11:
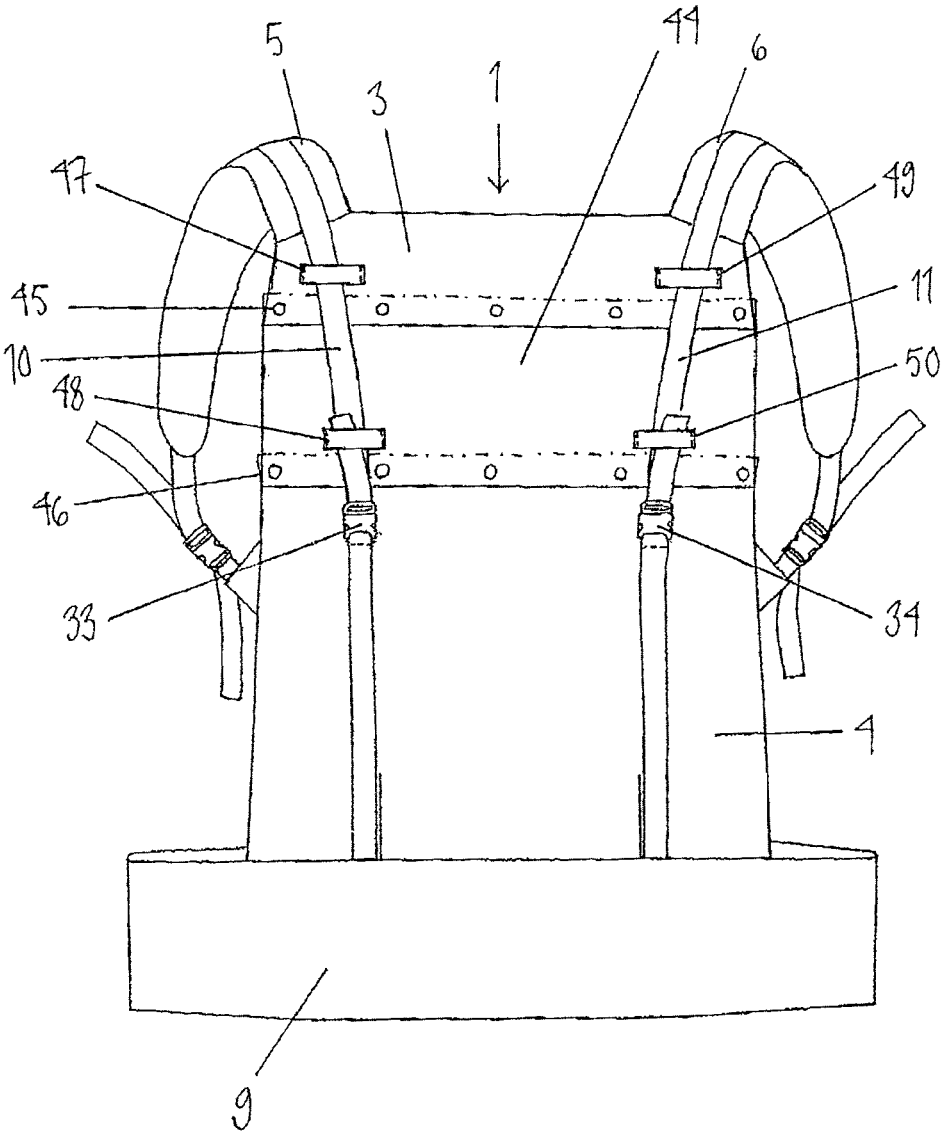
FIG. 11 presents a stepless length adjustment according to the invention, viewed from the outer, back side of the carrier, where in the carrying section there is a removably fastenable additional piece with snap fastener rows as attachment elements, and where the adjustment means consist of buckles and webbings or webbing straps, and also support loops.

FIG. 10 presents a multi-stepped length adjustment of the carrier 1 according to the invention, where the upper part 3 of the carrier 1 is removably fastened and where the adjustment and attachment means consist of snap fastener rows 29-32 and buckles 33-35 and the adjustment elements consist of webbing straps 10, 11, 36 and also support loops 37-43. Respectively, FIG. 11 presents a stepless length adjustment of the carrier 1 according to the invention, where in the carrying section 2 there is a removably fastenable additional piece 44 with snap fastener rows 45, 46 as attachment elements. In the solution according to FIG. 11 the adjustment means consist of buckles 33, 34 and the adjustment elements consist of webbing straps 10, 11 and also support loops 47-50.

Figure 12:
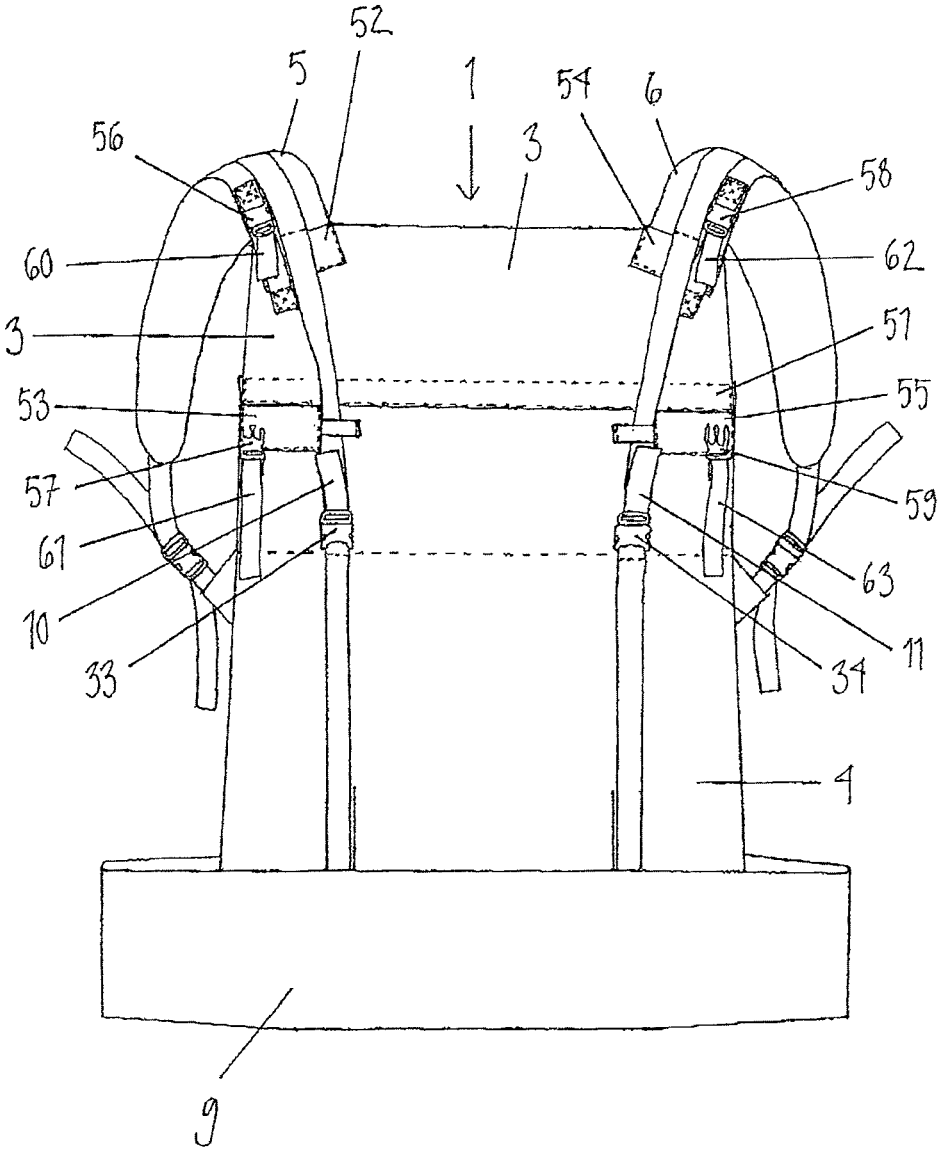
FIG. 12 presents a stepless length adjustment according to the invention, viewed from the outer, back side of the carrier, where the adjustment means consist of buckles and webbings or webbing straps and where there is a removably fastened upper part with snap fastener tape as the attachment means.

FIG. 12 presents yet another stepless length adjustment solution of the carrier 1 according to the invention, where the adjustment means consist of buckles 33, 34 and the adjustment elements consist of webbing straps 10, 11. In the carrier 1 there is a removably fastened upper part 3 with snap fastener tape 51 as the attachment means. In the carrier 1 there are also removably fastened upper straps 5, 6 with pockets 52-55 and buckles 56-59 and webbing straps 60-63 as the attachment means.

Figure 13:
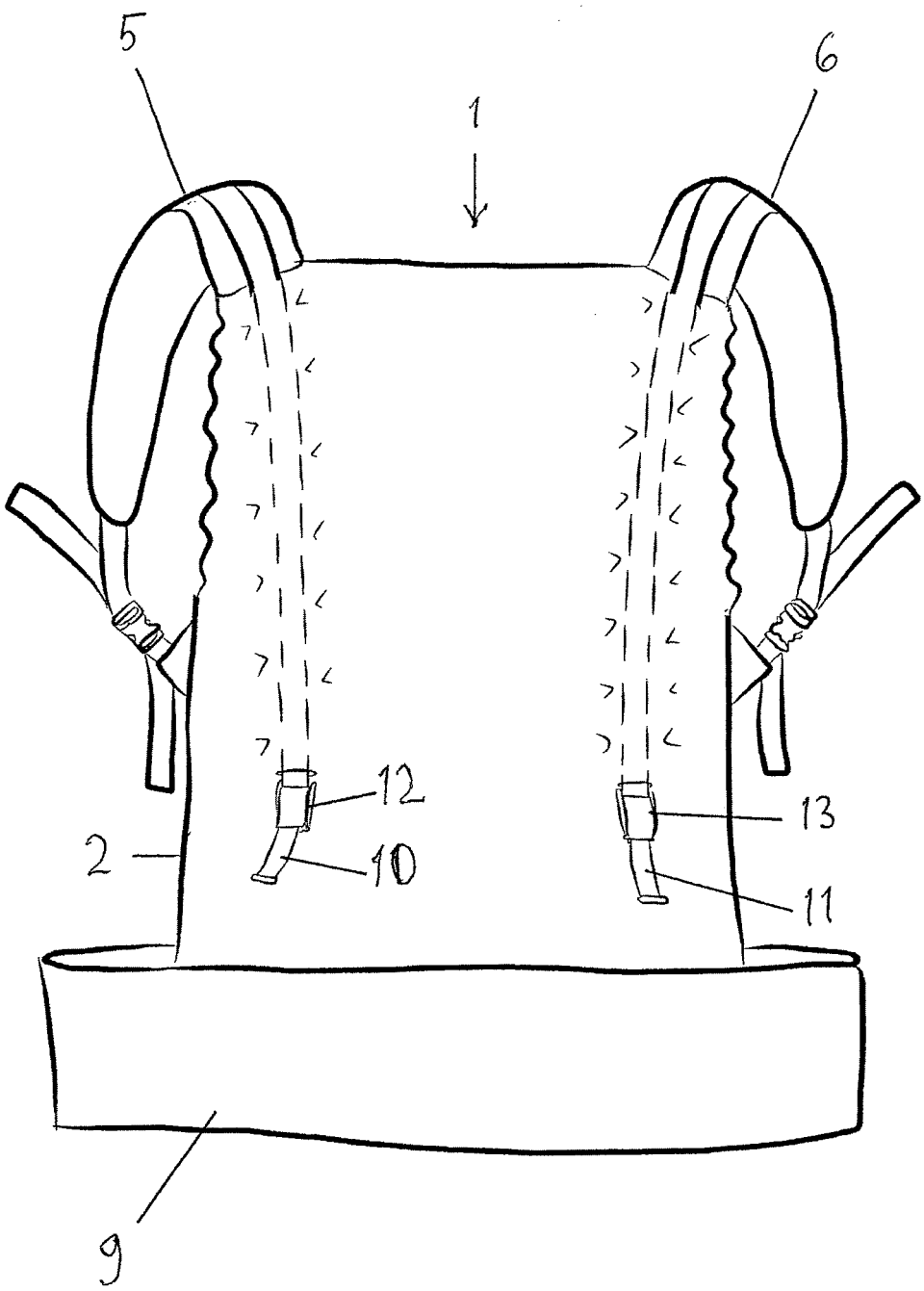
FIG. 13 presents a stepless length adjustment according to the invention, viewed from the outer, back side of the carrier, where in the carrying section there are two or more channels within which webbing parts such as webbing straps or belts run and are locked with the adjustment means like belt buckles that are fastened to a lower part of the carrying section itself.

FIG. 13 presents a stepless length adjustment according to the invention, where in the carrying section 2 there are two or more channels within which webbing parts such as webbing straps 10, 11 or belts run and are locked with belt buckles 12, 13 that are fastened to a lower part of the carrying section 2 itself. In this solution only upper webbing parts such as webbing straps 10, 11 or belts are needed. Separate lower webbing parts are not needed because the webbing straps 10, 11 are locked directly to the belt buckles 12, 13. The webbing straps 10, 11 are placed into webbing channels, which are either separate or sewn in the carrying section 2.

Figure 14:
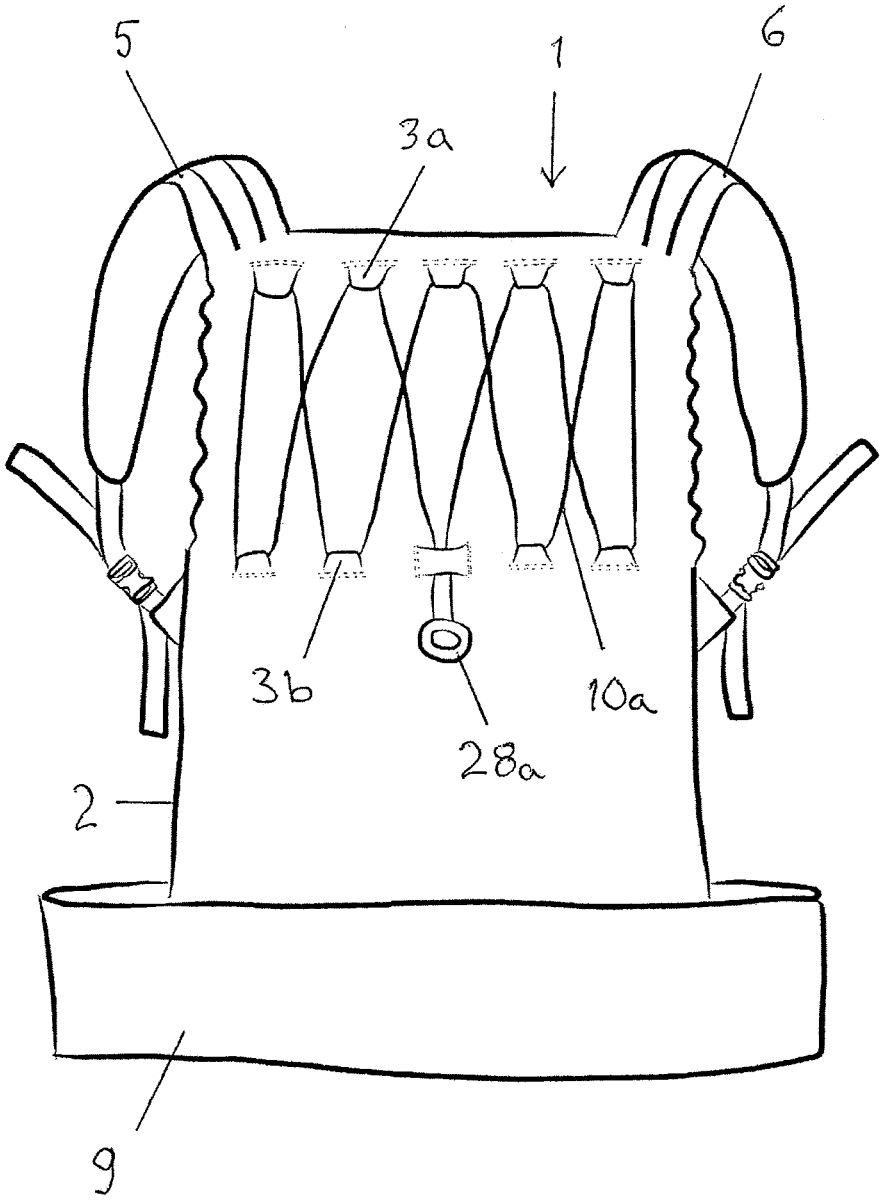
FIG. 14 presents a stepless length adjustment according to the invention, viewed from the outer, back side of the carrier, where the length adjustment elements and means consist of a string, such as a shoestring or alike, and holding means through which the string is guided.

FIG. 14 presents a stepless length adjustment according to the invention, where the length adjustment elements consist of a string 10*a*, such as a shoestring or alike, and upper holding means 3*a* and lower holding means 3*b* through which holding means 3*a*, 3*b* the string 10*a* is guided so that when shortening the length of the string 10*a* the distance between the upper holding means 3*a* and lower holding means 3*b* becomes shorter. At the same time the length of the back part of the carrying section 2 shortens correspondingly. When the length of the string 10*a* is made bigger the length of the back part of the carrying section 2 becomes correspondingly bigger. The length of the string 10*a* can be locked in a desired position with a locking element 28*a*.

The multi-stepped or stepless length adjustment of the carrier 1 according to the invention, which carrier 1 is intended for carrying a child, consists of webbings or webbing straps, thongs or straps acting as the adjustment elements 10, 10*a* 11 and 14, which are placed on top of/under the carrying section 2 or in between its fabric layers, and of various adjustment means 12, 13, 15-24, 26, 29-34. The adjustment means include various buckles 12, 13, 17, 33-34, snap fasteners 19-23, 29-32, snap fastener tape, Velcro tape 24, buttons or rings 15, 16. For example, there can be one or several webbing straps acting as adjustment elements. Each adjustment element consists at least of an upper webbing part, which is essentially attached near to the top edge of the upper part 3 of the carrying section 2 by its top end, and of a lower webbing part, which is attachable to the upper webbing part with the adjustment means, and which is attached by its lower end to the lower support elements, such as the hip belt 9 or the lower straps 7, 8. When adjusting the length of the carrying section 2, the adjustment elements are locked to a desired position with the adjustment means. The adjustment elements 10, 11 and 14 are, for example, various ready-made webbing straps and made of the same or a different fabric than the carrying section 2 is made of. What is essential is that the adjustment elements are sufficiently durable for adjustment use, particularly when the upper part 3 of the carrying section 2 is removably fastened as presented in FIGS. 10-12. Upper webbing parts can begin from the point where the shoulder straps 5, 6 are attached to the top part of carrying section 2, or they can be extended and sewn on top of the shoulder straps 5, 6 as shown for example in FIG. 7. The lower webbing parts are advantageously fastened with their lower ends to the lower support elements 7, 8 or 9. The buckles 12, 13, 17, 33-35 or other adjustment means 15, 16, 18-24, 28, 29-32 can be attached either to the webbing strap attached to the lower edge of the adjustable part as shown in FIG. 1, or to the webbing strap attached near to the shoulder as shown in FIGS. 3 and 4.

The above description represents the most advantageous embodiments of the invention. Those skilled in the art will see, however, that the invention is not limited to the embodiment examples presented above, but can be varied within the scope of the patent claims presented below. The webbings or webbing straps can alternatively be placed into webbing channels 25, which are either separate or sewn in between the fabrics of the carrying section 2, and which have cord locks 28 as adjustment means in their one end or both ends or in the middle as shown in FIG. 8. The upper part 3 of the carrying section 2 can be removably fastened to the lower part 4 of the carrying section 2, and in between these there may be one or several additional parts 44. In the removably fastened model the support loops 37-43, 47-50 are helpful in keeping the webbing straps in place.

The parts, shape and length of the multi-stepped or stepless adjustment of the carrier 1 according to the invention can be varied to optimally suit each carrier. For example, zippers, snap fasteners, snap fastener tape and Velcro tape are suitable to act as the attachment means 29-32, 45, 46, 51 of the removably fastened upper part 3 and the additional part/parts 44 of the carrying section 2. Other variation possibilities of the invention include adding various removable or non-removable linings and/or various removable or non-removable, foldable or non-foldable neck or head rests or supports.

In its own way, the neck/head rest or support can, when in use, add to the total height of the total carrier, this, however, without altering the height of the carrying section, intended primarily to support the back of the child, itself.

In addition, the length and the width of the webbings or webbing straps, straps and other adjustment parts can be varied. Knots and various fastening clips can be used instead of cord locks. The carrier can be made as a one-size solution or in several sizes.

The invention claimed is:

1. A carrier including an arrangement for adjusting the height of a carrier, the carrier comprising: a carrying section intended for carrying a child and having a top edge, upper support elements attached to an upper portion of the carrying section and placed over a wearer's shoulders, lower support elements to be placed around the wearer's body attached to a lower portion of the carrying section, and essentially webbing like adjustment elements mounted to the carrying section and providing multistepped or stepless height adjustment to the carrying section, thereby adjusting the distance between the top edge of the carrying section and lower support elements, wherein the height of the carrying section is configured to be adjusted, with the webbing like adjustment elements placed between the lower support elements on the carrying section, and the upper support elements situated at a top edge of a upper part of the carrying section, and with adjusters connected to the webbing like adjustment elements on the carrying section, in a manner such that the upper part of the carrying section is folded towards the lower support elements.

2. An arrangement according to claim 1, wherein the lower support elements include a hip belt or lower straps.

3. An arrangement according to claim 1 or 2, wherein the carrying section is removably fastened.

4. An arrangement according to claim 1, wherein the webbing like adjustment elements are fitted to begin from the upper support elements, from a top surface of the upper support elements, from between fabric layers of the upper support elements, from the top of the carrying section or from between fabric layers of the carrying section or other similar spots.

5. An arrangement according to claim 1, wherein adjusters comprising buckles, rings, snap fasteners, snap fastener tapes or hook and loop are placed at any spot on the webbing like adjustment elements and the carrying section.

6. An arrangement according to claim 1, further comprising, one or more support loops which secure said carrying section and adjustment elements.

7. An arrangement according to claim 1, wherein the carrying section is removably fastened, and additional adjusters keep in place the removably fastened carrying section and additional parts, where the adjusters are placed at the spots of the carrying section that are on top of each other, or at other suitable spots.

8. An arrangement according to claim 2, wherein the various webbing like adjustment elements are fitted to begin from the upper support elements, from the top surface of the upper support elements, from between the fabric layers of the upper support elements, from the top of the carrying section or from between the fabric layers of the carrying section.

9. An arrangement according to claim 3, wherein the various webbing like adjustment elements are fitted to begin from the upper support elements, from the top surface of the upper support elements, from between the fabric layers of the upper support elements, from the top of the carrying section or from between the fabric layers of the carrying section or other similar spots.

10. An arrangement according to claim 2, wherein the adjusters are placed at any spot on the webbing like adjustment elements and the carrying section.

11. An arrangement according to claim 3, wherein the adjusters are placed at any spot on the webbing like adjustment elements and the carrying section.

12. An arrangement according to claim 4, wherein adjusters are placed at any spot on the webbing like adjustment elements and the carrying section.

13. An arrangement according to claim 2, further comprising, one or more support loops which secure said carrying section and adjustment elements.

14. An arrangement according to claim 3, further comprising, one or more support loops which secure said carrying section and adjustment elements.

15. An arrangement according to claim 4, further comprising, one or more support loops which secure said carrying section and adjustment elements.

16. An arrangement according to claim 5, further comprising, one or more support loops which secure said carrying section and adjustment elements.

17. An arrangement according to claim 2, wherein the carrying section is removably fastened, and additional adjusters further keep in place the removably fastened carrying section and additional parts, where the additional adjusters are placed at the spots of the carrying section that are on top of each other, or at other suitable spots.

18. An arrangement according to claim 14, wherein the carrying section is removably fastened, and additional adjusters keep in place the removably fastened carrying section and additional parts, where the additional adjusters are placed at the spots of the carrying section that are on top of each other, or at other suitable spots.

19. An arrangement according to claim 15, wherein the carrying section is removably fastened, and additional adjusters keep in place the removably fastened carrying section and additional parts, where the additional adjusters are placed at the spots of the carrying section that are on top of each other, or at other suitable spots.

* * * * *